US009610635B2

(12) United States Patent
Muller et al.

(10) Patent No.: US 9,610,635 B2
(45) Date of Patent: Apr. 4, 2017

(54) METHODS FOR MANUFACTURING THIN WALLED ENCLOSURES AND RELATED SYSTEM AND APPARATUS

(71) Applicant: Apple Inc., Cupertino, CA (US)

(72) Inventors: Peter R. Muller, San Luis Obispo, CA (US); Michael T. Brickner, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 237 days.

(21) Appl. No.: 14/227,378

(22) Filed: Mar. 27, 2014

(65) Prior Publication Data

US 2015/0040376 A1 Feb. 12, 2015

Related U.S. Application Data

(60) Provisional application No. 61/864,472, filed on Aug. 9, 2013.

(51) Int. Cl.
*B22D 19/08* (2006.01)
*B22D 19/04* (2006.01)
*B22D 39/00* (2006.01)

(52) U.S. Cl.
CPC ..... *B22D 19/04* (2013.01); *B22D 19/08* (2013.01); *B22D 39/00* (2013.01); *Y10T 29/49988* (2015.01); *Y10T 29/5184* (2015.01)

(58) Field of Classification Search
CPC ..... B22D 19/04; B22D 19/08; B22D 39/00; Y10T 29/5184; Y10T 29/49988; Y10T 29/49623; B23Q 3/086
See application file for complete search history.

(56) References Cited

U.S. PATENT DOCUMENTS 3,790,152 A * 2/1974 Parsons ..... B23Q 3/086 269/58
4,509,673 A * 4/1985 Schmidt ..... B23K 37/04 228/212

(Continued)

FOREIGN PATENT DOCUMENTS

CN 1415774 A 5/2003
CN 1762619 A 4/2006

(Continued)

OTHER PUBLICATIONS

Qiu Baoan et al, "Application of Low Melting Point Alloys to Processing of TC4 Case Packaging" , Electro-Mechanical Engineering vol. 25, No. 3; pp. 42-45 (Mar. 31, 2009).

(Continued)

*Primary Examiner* — Sarang Afzali
*Assistant Examiner* — Ruth G Hidalgo-Hernandez
(74) *Attorney, Agent, or Firm* — Downey Brand LLP

(57) ABSTRACT

A manufacturing system is provided. The manufacturing system may include a manufacturing apparatus and a dispensing apparatus. The dispensing apparatus may be configured to dispense a support material to act as a temporary fixture to support a component during manufacturing operations conducted thereon. The dispensing apparatus may dispense the support material in a liquid phase, and the support material may thereafter transition to a solid phase to support the component. After completion of the manufacturing operations, the component may be returned to the dispensing apparatus, wherein the component may be dipped in a heat transfer fluid that may cause the support material to transition back to the liquid phase for reuse. Related apparatuses and methods are also provided.

20 Claims, 10 Drawing Sheets

(56) References Cited

U.S. PATENT DOCUMENTS

| | | | | |
|---|---|---|---|---|
| 5,947,662 | A | 9/1999 | Becker et al. | |
| 6,283,197 | B1 * | 9/2001 | Kono | B22D 17/007 164/312 |
| 2006/0182887 | A1 * | 8/2006 | Miller | B05C 5/001 427/256 |

FOREIGN PATENT DOCUMENTS

| | | | |
|---|---|---|---|
| CN | 101069949 | A | 11/2007 |
| CN | 103203592 | A | 7/2013 |
| GB | 685481 | A | 1/1953 |
| JP | S6268201 | A | 3/1987 |

OTHER PUBLICATIONS

Zhao Changxi, "Application and Study of Low Melting Point Alloy in Manufacturing of Complex Thin-wall Components", Aerospace Manufacturing Technique, No. 2, pp. 15-18 (Apr. 30, 2006).

Chinese Patent Application No. 201410387111.2—Second Office Action dated Nov. 2, 2016.

* cited by examiner

METHODS FOR MANUFACTURING THIN WALLED ENCLOSURES AND RELATED SYSTEM AND APPARATUS

CROSS-REFERENCE TO RELATED APPLICATIONS

The present application claims the benefit of U.S. Provisional Application No. 61/864,472, entitled "METHOD FOR MANUFACTURING USING A PHASE-TRANSITIONING SUPPORT MATERIAL AND RELATED SYSTEM AND APPARATUS" filed Aug. 9, 2013, the contents of which are incorporated herein by reference in their entirety for all purposes.

FIELD

The present disclosure relates generally to manufacturing, and more particularly to manufacturing using a phase-transitioning support material.

BACKGROUND

The quest for production of smaller, lighter, and cheaper devices is ongoing. In this regard, by way of example, it may be desirable to produce housings for devices such as computing devices that are relatively thin in order to provide benefits such as reduced material usage, reduced size, and reduced weight. However, the production of thin-walled housings may present certain challenges.

For example, harmonics, deflection, and distortion occurring during clamping, fixturing, and machining processes may produce an unacceptable part. The reasons for failure may include (but are not limited to) distortion, geometric inaccuracy, poor surface finish, or poor cosmetics. Accordingly, if the component is salvageable, extended finishing operations may be required. Attempts to avoid the above-noted problems may involve machining the components at lower feed rates compared to solid materials. However, increased cycle times may result in increased productions costs.

SUMMARY

Embodiments of the present disclosure relate to use of a support material as a temporary fixture to support a component during manufacturing. In one embodiment, a method of manufacturing is set forth including a step of dispensing a support material in a liquid phase from a dispensing apparatus onto a component. Additionally, the method can include allowing the support material to transition into to a solid phase and performing a machining operation on the component. Finally, the method can include recovering the support material in the dispensing apparatus such that the support material can be reused.

In another embodiment, a manufacturing system is set forth. The manufacturing system can include a machining apparatus configured to perform a machining operation on a component supported by a support material. The manufacturing system can also include a dispensing apparatus configured to dispense the support material in a liquid phase. The support material can then come into contact with the component and transition into a solid phase before the machining apparatus performs the machining operation on the component. The manufacturing system can also include the ability to recover the support material after the machining apparatus performs the machining operation on the component so that the support material can be reused.

In yet another embodiment, a dispensing apparatus is set forth. The dispensing apparatus can include a vessel configured to receive a support material and a heat transfer fluid, and have a first opening and a second opening. The dispensing apparatus can further include a heater configured to heat the heat transfer fluid and the support material in the vessel such that the support material is in a liquid phase. Additionally, the dispensing apparatus can include one or more nozzles in fluid communication with the first opening of the vessel. The nozzles can be configured to dispense the support material into contact with a component. The second opening of the vessel can be configured to receive the component after a machining operation is performed on the component to recover the support material such that the support material can be reused.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed apparatuses, assemblies, methods, and systems. These drawings in no way limit any changes in form and detail that may be made to the disclosure by one skilled in the art without departing from the spirit and scope of the disclosure.

DETAILED DESCRIPTION

Representative applications of systems, apparatuses, and methods according to the presently described embodiments are provided in this section. These examples are being provided solely to add context and aid in the understanding of the described embodiments. It will thus be apparent to one skilled in the art that the presently described embodiments can be practiced without some or all of these specific details. In other instances, well known process steps have not been described in detail in order to avoid unnecessarily obscuring the presently described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

As described in detail below, the following relates to manufacturing a component using a phase-transitioning support material to support the component. In this regard, it may be desirable to produce components that are relatively thin-walled. For example, it may be desirable to produce computing devices having relatively thin walls in order to reduce the overall size of the computing device, particularly when the computing device is configured to be portable. Reduction in wall thickness can provide additional benefits such as reduced material usage and reduced weight.

However, the production of relatively thin-walled structures can present certain issues. For example, the stresses imparted to the component during machining operations performed on the component can cause the component to bend and thereby define a structure failing to meet specified tolerances. Alternatively, or additionally, movement of the component during machining operations performed on the component can cause the surface finish of the component to differ from the desired finish. Note that machining operations, as used herein, refers not only to operations in which material is moved from the component (e.g., cutting, milling, grinding, drilling, etc.), but also other operations performed on the component such as welding and finishing operations, etc.

Figure 1:
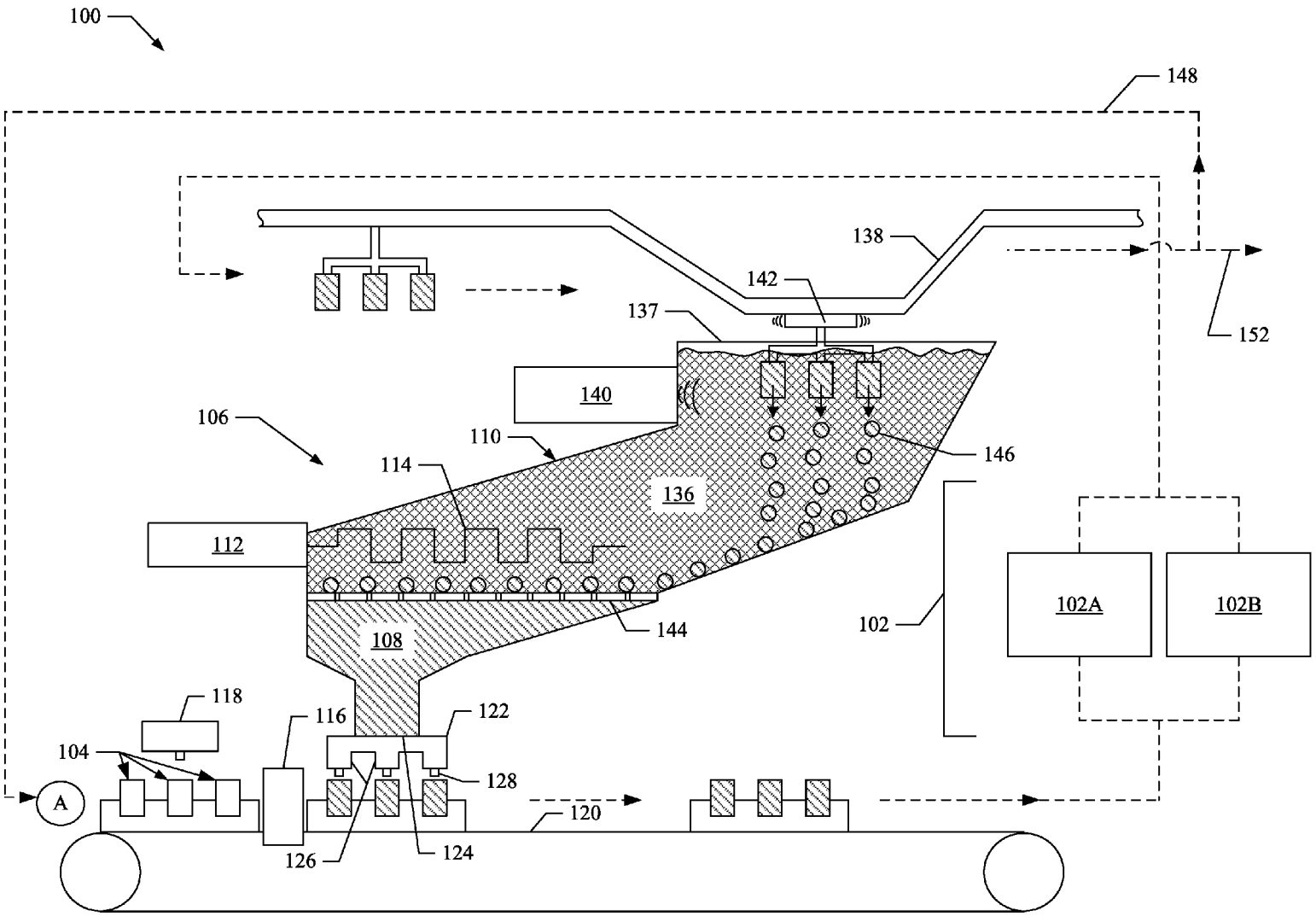
FIG. 1 illustrates a manufacturing system including a support material dispensing apparatus according to an example embodiment of the present disclosure.

In this regard, FIG. 1 illustrates a manufacturing system 100 according to an embodiment of the present disclosure. As illustrated, the manufacturing system 100 can include one or more machining apparatuses 102. For example, a first machining apparatus 102A and second machining apparatus 102B can be configured to perform one or more machining operations on components 104. The components 104 can comprise any of various components employed to form computing devices and/or any other suitable device, apparatus, or assembly.

The manufacturing system 100 can further comprise a dispensing apparatus 106 configured to dispense a support material 108 into contact with the components 104. As described hereinafter, the support material 108 can be configured to provide temporary support to the components 104 and/or perform other functions that aid the machining apparatuses 102 in performing machining operations thereon. As illustrated, the dispensing apparatus 106 can comprise a vessel 110 in which the support material 108 is received. The dispensing apparatus 106 can be configured to dispense the support material 108 in a liquid phase. In this regard, the dispensing apparatus 106 can include a heater 112 configured to heat the support material 108 in the vessel 110 such that the support material defines a liquid phase. For example, the heater 112 can include a resistive heating element 114 that extends within the vessel 110 in order to directly or indirectly heat the support material 108. However, it should be understood that various other embodiments of heaters can be employed (e.g., gas burners, induction heating, etc.).

In some embodiments the manufacturing system 100 can further comprise a preheating unit 116. The preheating unit 116 can be configured to preheat the components 104 prior to dispensing the support material 108 thereon. For example, the preheating unit 116 can comprise a gas or electric oven, a water bath, or any other embodiment of a heater 112 configured to preheat the components 104. In one embodiment the preheating unit 116 can be configured to heat the components 104 to the temperature that the support material 108 is heated in the dispensing apparatus 106. Accordingly, application of the support material 108 to each component 104 may not impart a thermal shock thereto, which can otherwise distort the component 104, and the cooling of the support material 108 and component 104 can result in a controlled contraction, as discussed below, based on the respective coefficients of thermal expansion.

After being deposited on the component 104, the support material 108 can be configured to transition to a solid phase prior to the machining apparatuses 102 performing machining operations on the components 104. In this regard, the support material 108 can be configured to support the component 104 such that the machining operations performed by the machining apparatus 102 may not cause the component 104 to fall outside of tolerances for shape, surface finish, and/or other specifications for the final form of the component 104. For example, as noted above, in some embodiments the component 104 can be relatively thin-walled (e.g., defining a wall thickness of about 0.8 millimeters or less) in its final form after completion of the manufacturing operations, therefore use of the support material 108 should be used to support the component 104, and can resist bending or movement of the component 104 during the manufacturing operations. As described in greater detail below, the support material 108 can define a temporary fixture that supports the component 104.

The particular support material 108 employed can be selected based on a number of factors. For example, the melting point of the support material 108 can be less than a melting point of the material(s) defining the component 104. Accordingly, as described below, in some embodiments the support material 108 can be removed from the component 104 by melting the support material without affecting component 104. By way of example, in some embodiments the component 104 can comprise an aluminum alloy. Pure aluminum defines a melting point of about 1220 degrees Fahrenheit and aluminum alloys define melting points generally in a range from about 865 degrees Fahrenheit to about 1240 degrees Fahrenheit. Thus, the support material 108 can define a lesser melting point, as compared to the material of component 104, such as a melting point in the range from about 130 to about 400 degrees Fahrenheit.

Note that the melting point of the support material 108 can be above the highest temperature the support material can be exposed to during the manufacturing operations. In this regard, the support material 108 can define a melting point that is above an ambient temperature at which the manufacturing operations occur and above a temperature caused by any heat imparted to the support material during the manufacturing operations. For example, as the component 104 is machined by one of the machining apparatuses 102, the temperature of the support material 108 in contact therewith can rise due to conduction and/or other heat transfer.

The particular support material 108 employed can also be selected based on the coefficient of thermal expansion thereof. In this regard, in one embodiment the coefficient of thermal expansion of the support material 108 can be selected to match that of the material defining the component 104. Accordingly, as the component 104 is heated and expands during manufacturing operations performed thereon and thereafter cools and contracts, the support material 108 can expand and contract at the same rate.

However, in other embodiments the coefficient of thermal expansion of the support material 108 can differ from that of the material defining the component 104. For example, in some embodiments the coefficient of thermal expansion of the support material 108 can be higher than the coefficient of thermal expansion of the material defining the component 104. In this regard, when the support material 108 is employed to at least partially surround the component 104, the support material can apply a preload to the component 104 in the form of compressive forces, which can be useful in counteracting forces applied to the component during manufacturing operations.

In another embodiment the support material 108 can define a coefficient of thermal expansion that is less than the coefficient of thermal expansion of the component 104. This configuration can result in the support material 108 shrinking to a lesser extent than the component 104. Accordingly, for example, when the support material 108 at least partially fills a cavity defined by the component 104, the support material can preload the component 104 by outwardly pressing thereon, which can be useful in counteracting forces applied to the component 104 during manufacturing operations.

With respect to other properties of the support material 108, the support material can be non-corrosive to the material defining the component 104. Accordingly, contact between the support material 108 and the component 104 may not damage the component 104. For example, if the component 104 is anodized prior to dispensing the support material 108 on component 104, the support material can be configured to not damage a sealer on component 104. However, anodization and other finishing operations can be performed during or after the machining operations performed by the machining apparatuses 102 in some embodiments.

Further, the support material 108 can be configured to withstand repeated melting and solidification without any substantial change in material properties or material loss. The support material 108 can also be configured to not attract or retain contaminants during use. In this regard, as discussed below, the support material 108 can be reused. Additionally, the support material 108 can be configured to bond to the material defining the component 104. Accordingly, the support material 108 can remain in contact with the component 104 during machining operations conducted on component 104. The support material 108 can also be configured to freely-release from the material defining the component 104 when desired. For example, as described below, the support material 108 can be reheated to the liquid phase to release the support material from the component 104. Thus, the selected support material 108 can define a relatively low-surface tension in some embodiments.

Accordingly, based on the various factors described above, an appropriate support material 108 can be selected. In some embodiments the support material 108 can comprise a low melt alloy. As discussed herein, low melt alloys refer to alloys with melting points within a range from about 117 degrees Fahrenheit to about 300 degrees Fahrenheit. Alloys, including low melt alloys, can provide significant structural support when in a solid phase. Example embodiments of low melt alloys that can be employed as the support material 108 can include Bolton #136, as sold by BOLTON METAL, Field's metal, bismuth, tin, lead, cadmium, indium, or any suitable material, or combination thereof.

As noted above, the support material 108 can be selected such that it tends to easily release from the material defining the component 104 when melted. In order to assist in release of the support material 108 from the component 104, in some embodiments the manufacturing system 100 can further comprise a release agent applicator 118. The release agent applicator 118 can be configured to apply a coating of a release agent to the component 104 prior to the dispensing apparatus 106 dispensing the support material 108 component 104. The release agent can comprise a material such as a dry powdered lubricant (e.g., graphite), configured to aid in release of the support material 108 at a later time.

In terms of the order of the operations described above, the components 104 can be initially provided in an unfinished form at a starting point A. As illustrated, in some embodiments a plurality of the components 104 can be processed as a batch. A transport apparatus such as a conveyor 120 can direct the components 104 to the release agent applicator 118 and the preheating unit 116, where the components 104 can be treated with a release agent and preheated. Thereafter, the components 104 can be directed to the dispensing apparatus 106. As illustrated, the vessel 110 can comprise a manifold 122 at a first opening 124. The manifold 122 can include a plurality of runners 126 respectively coupled to at least one nozzle 128. Accordingly, in some embodiments of the manufacturing system 100 processing multiple components 104 at a time, the support material 108 can be applied to each component 104 substantially simultaneously. However, it should be understood that the operations described herein can be performed on the components 104 individually and sequentially in other embodiments.

Figure 2:
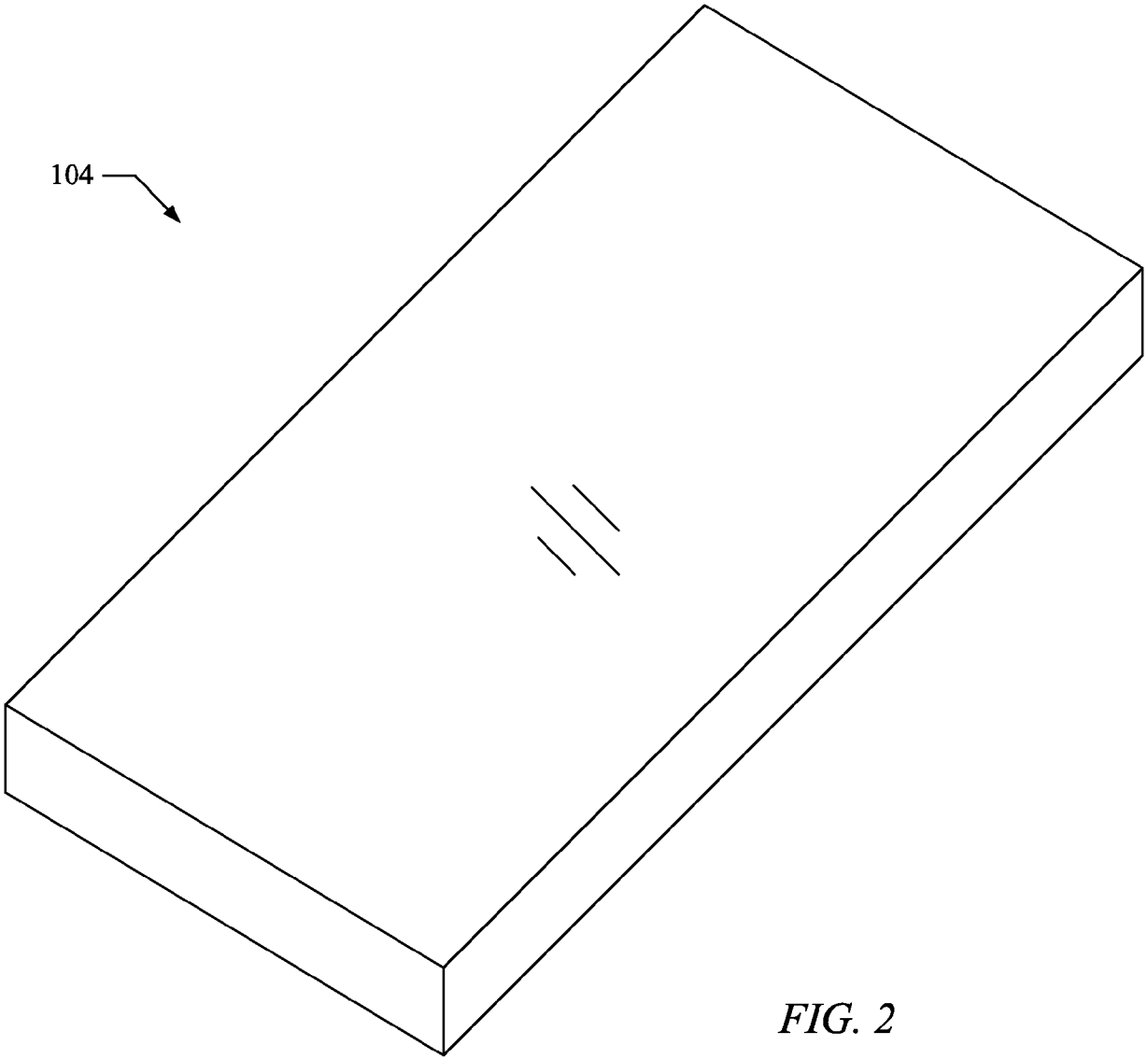
FIG. 2 illustrates a perspective view of a component according to an example embodiment of the present disclosure.
Figure 3:
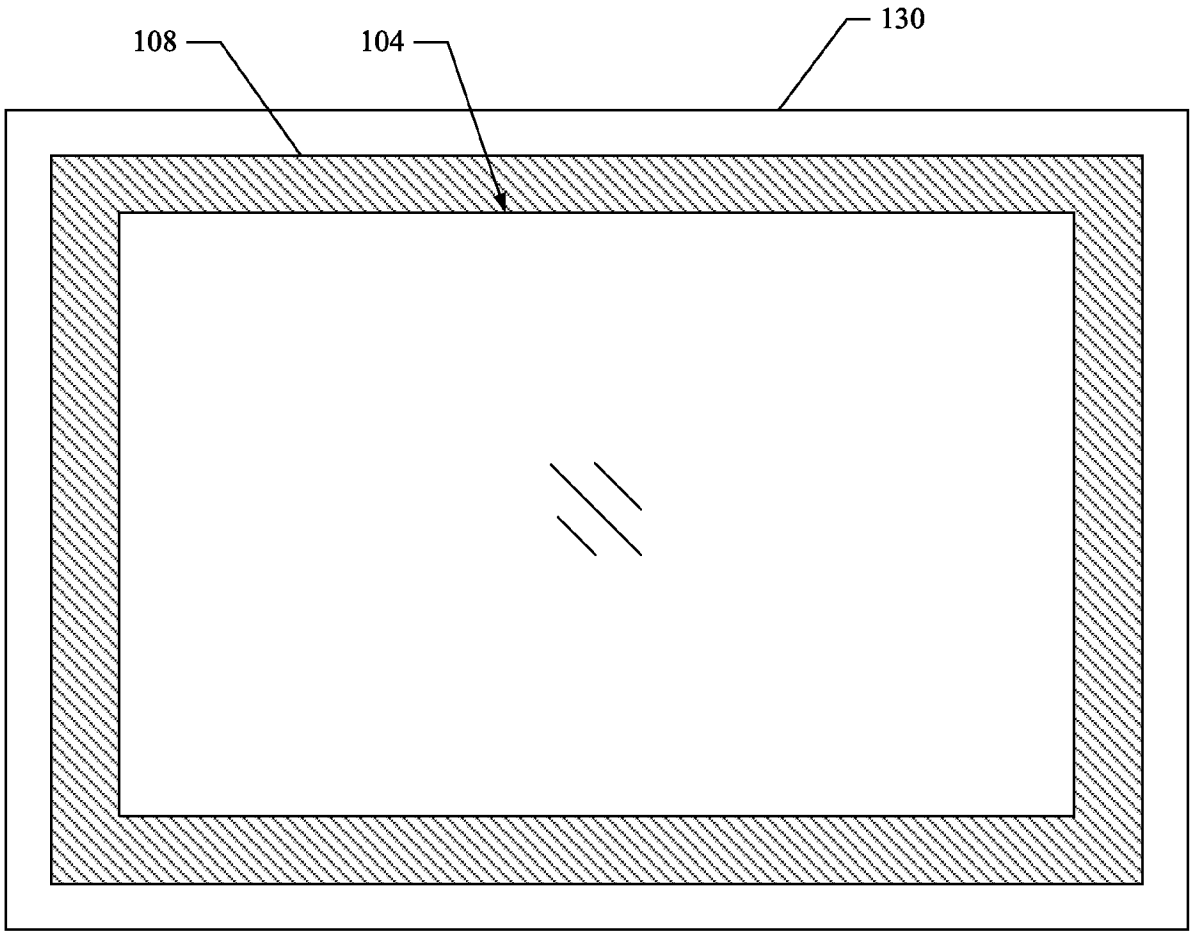
FIG. 3 illustrates a top view of the component of FIG. 2 in a mold and at least partially surrounded by a support material according to an example embodiment of the present disclosure.

The particular manner in which the support material 108 is applied to each component 104 can vary. For example, FIG. 2 illustrates a perspective view of a component 104 in an unfinished form. FIG. 3 illustrates a top view of the component 104 after the support material 108 at least partially surrounds an exterior surface. As illustrated, the support material 108 can be applied around the perimeter of the component 104 and/or on a back surface thereof. In this regard, the component 104 can be placed in a mold 130 and the support material 108 can be applied at least partially around the component 104.

Figure 4:
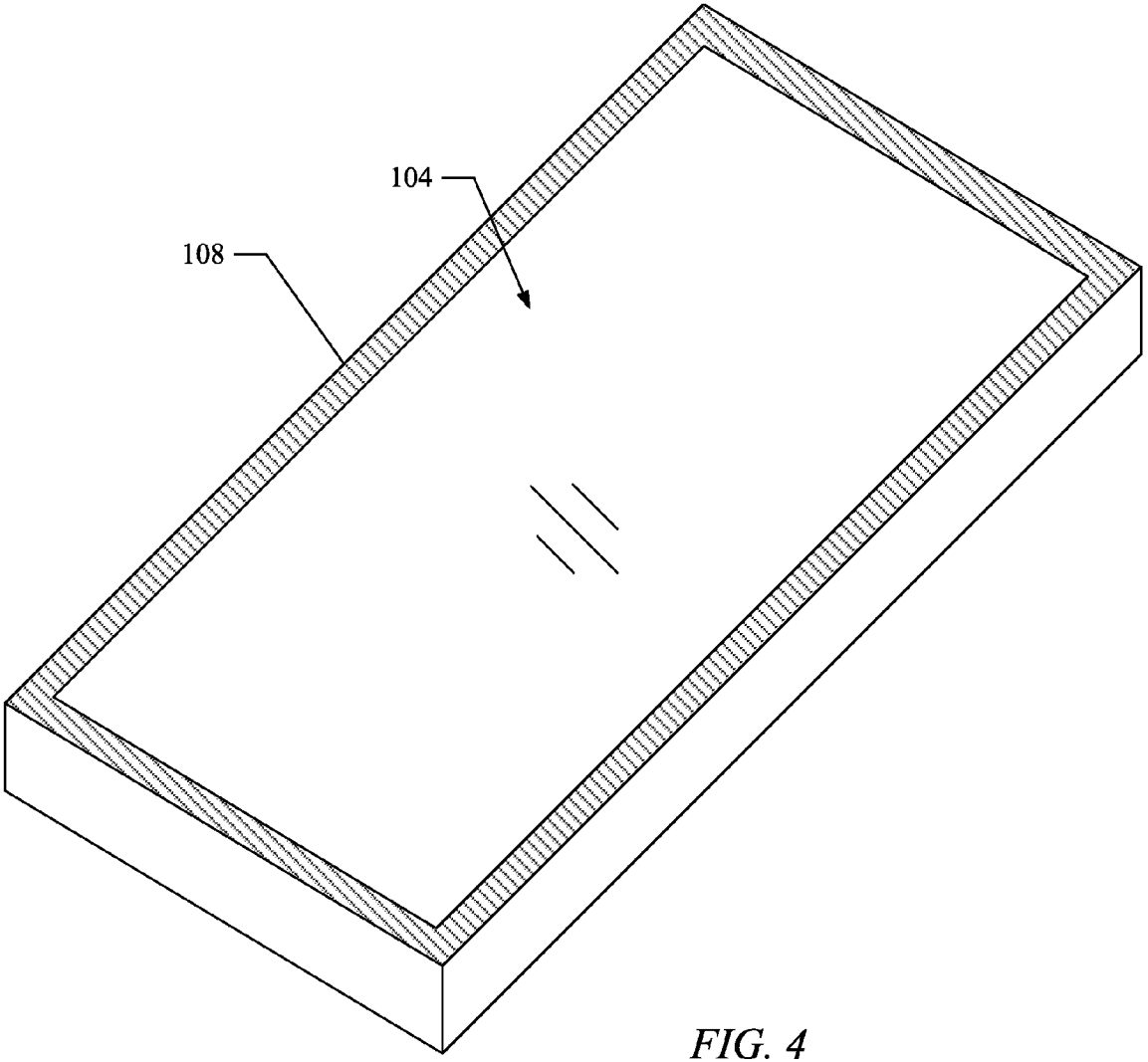
FIG. 4 illustrates a perspective view of the component of FIG. 2 at least partially surrounded by the support material according to an example embodiment of the present disclosure.

Thereafter, the support material 108 can cool and transition to a solid state to form a temporary fixture around the component 104. As illustrated in FIG. 4, the component 104 can be removed from the mold 130 after the support material 108 transitions to a solid state such that the support material remains coupled to the component. Alternatively, in another embodiment the component can be retained in the mold 130 during the completion of subsequent operations.

Due to the support material 108 initially defining a liquid state, the support material can adapt to the particular shape of the component 104 to define a temporary fixture matching the size and shape of the component 104. Accordingly, regardless of the complexity of the shape of the component 104, the support material 108 can provide support thereto. In this regard, it can otherwise be difficult to support a component 104 defining complex structures such as splines, curves, etc. Since the support material 108 provides support to the component 104, the component 104 can be machined faster and/or more accurately, particularly when the component 104 defines, or is machined to define, relatively thin walls.

In this regard, as illustrated in FIG. 1, the component 104 can be transported to the one or more machining apparatuses 102 after the support material 108 is dispensed thereon. For example, the conveyor 120 can transport the component 104 from the dispensing apparatus 106 to the one or more machining apparatuses 102. In this regard, a first machining apparatus 102A and a second machining apparatus 102B can perform one or more machining operations on the component 104.

Figure 5:
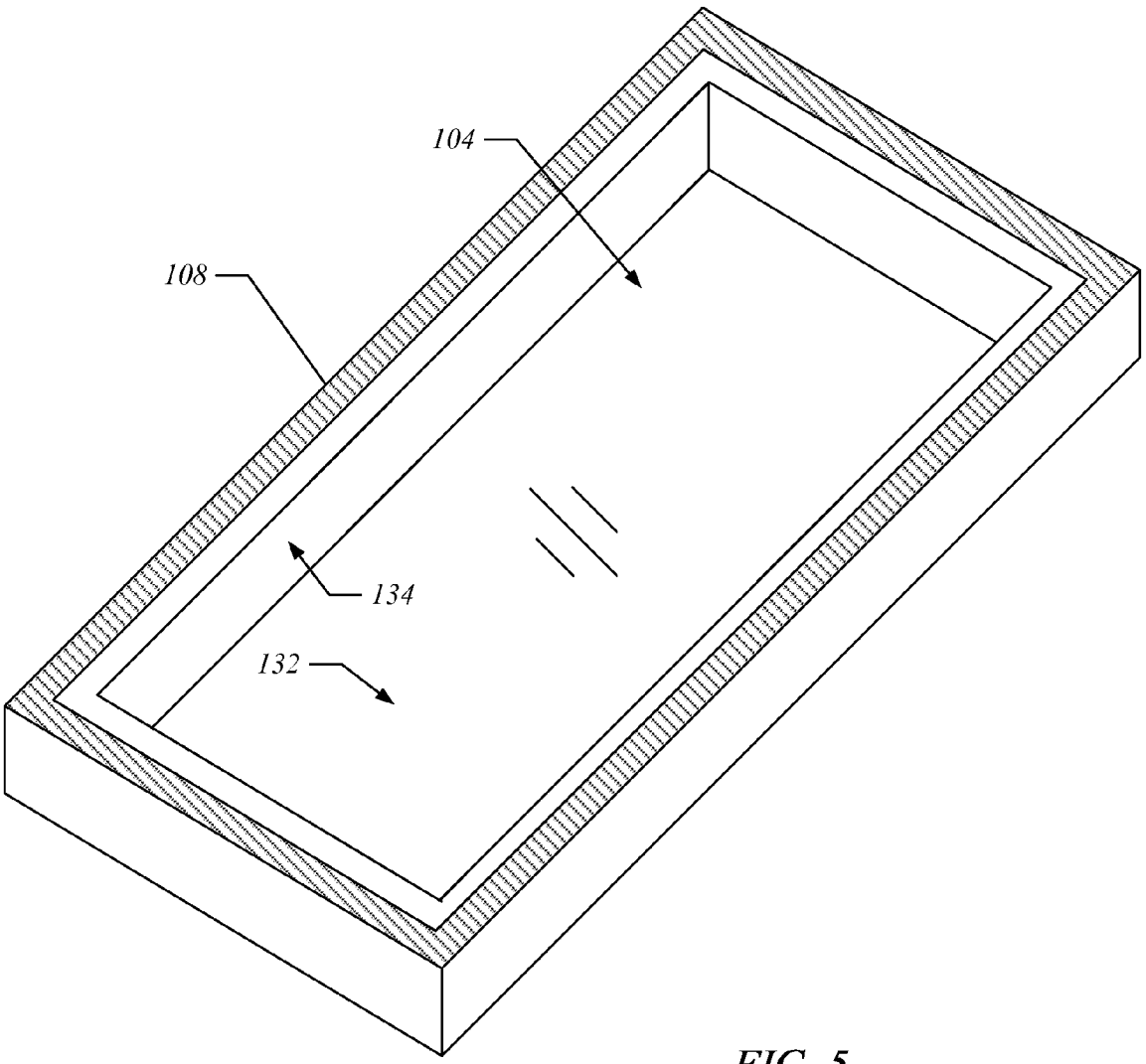
FIG. 5 illustrates a perspective view of the component of FIG. 2 at least partially surrounded by the support material and having a cavity machined according to an example embodiment of the present disclosure.

For example, the first machining apparatus 102A can remove a portion of the component 104 such that the component 104 defines a cavity 132, as illustrated in FIG. 5. During this machining operation performed by the first machining apparatus 102A, a plurality of walls 134 surrounding the cavity 132 can become relatively thin. Thus, as described above, the support material 108 can function to support the walls 134 during the machining operation by at least partially surrounding the walls and counteracting forces applied to component 104. Further, the support material 108 can act as a heat sink that draws heat away from the component 104, thus allowing for application of more heat to the component 104 than can otherwise be possible without damaging the component 104.

After the first machining apparatus 102A completes machining operations on the component 104, the support material 108 can still be coupled thereto. However, it may be desirable to reuse the support material 108 for a subsequent operation. Thus, the dispensing apparatus 106 can be further configured to recover the support material 108 after the first machining apparatus 102A performs the machining operations on the component 104 such that the support material can be reused.

In this regard, in the illustrated embodiment the vessel 110 of the dispensing apparatus 106 is at least partially filled with a heat transfer fluid 136. Thus, the component 104 can be submerged in the heat transfer fluid 136 after the first machining apparatus 102A performs one or more machining operations thereon in order to transition the support material 108 back to the liquid phase such that the support material can be removed from the component 104. For example, as illustrated, in one embodiment one or more of the components 104 can be transported via a monorail 137 or other transport apparatus and dipped into the heat transfer fluid 136 in the vessel 110. In this regard, the vessel 110 can define a second opening 138 at an upper portion thereof that is configured to receive one or more of the components 104. Accordingly, heat from the heat transfer fluid 136, which can be warmed by the above-described heater 112, can transition the support material 108 back to the liquid phase.

In one embodiment the heat transfer fluid 136 can be the same material as the support material 108. Thus, the support material 108 in a solid phase coupled to the component 104 can be melted by more of the support material already in a liquid phase and defining the heat transfer fluid 136. However, in another embodiment the heat transfer fluid 136 can comprise a material that differs from the support material 108. Use of a heat transfer fluid 136 differing from the support material 108 can assist in ensuring that none of the support material remains on the component 104 after being dipped therein. For example, the heat transfer fluid 136 can comprise a fluid that is liquid at ambient room temperatures, and hence any heat transfer fluid 136 remaining on the component 104 after being dipped therein can be removed relatively easily. For example, depending on the heat transfer fluid 136 employed, the heat transfer fluid can evaporate or be blown therefrom.

The particular heat transfer fluid 136 selected can depend on a number of factors. For example, the heat transfer fluid 136 can be configured to repel the support material 108. In this regard, the heat transfer fluid 136 and the support material 108 can define opposing polarities. Further, the heat transfer fluid 136 can be lubricious such that it does not stick to the component 104 and lubricating properties can also assist in removing the support material 108 from the component 104. The heat transfer fluid 136 can also be non-corrosive to the support material 108 and the material defining the component 104. Further, the heat transfer fluid 136 can be configured to not be absorbed by the support material 108. In some embodiments the heat transfer fluid 136 may not comprise an organic solvent (e.g., acetone and isopropanol), as they can boil at a relatively low temperature that can be insufficiently high to melt the support material 108 and/or the organic solvents may evaporate too quickly. Accordingly, based on these factors, example embodiments of the heat transfer fluid 136 include glycol, long chain polymer ethylene glycol, water-based machining coolant, water, air, or any combination thereof.

In order to assist the support material 108 in separating from the component 104, the manufacturing system 100 can further comprise a vibration unit configured to vibrate at least one of the component 104 and the heat transfer fluid 136. For example, the manufacturing system 100 can include an ultrasonic transducer 140 positioned on or in the vessel 110 and configured to vibrate the heat transfer fluid 136. Alternatively or additionally, the manufacturing system 100 can include a shaker 142 configured to vibrate the component 104. For example, the shaker 142 can comprise an electric motor coupled to an eccentric mass, although various other vibration units can be employed in other embodiments.

In embodiments in which the heat transfer fluid 136 differs from the support material 108, the dispensing apparatus 106 can further comprise a separator 144 configured to separate the support material 108 from the heat transfer fluid 136. In this regard, in some embodiments the heat transfer fluid 136 can be selected such that it is less dense than the support material 108. Accordingly, droplets 146 or other units of the support material 108 melting off of the component 104 in the vessel 110 can sink downwardly through the heat transfer fluid 136. The separator 144 can allow the denser support material 108 to travel downwardly therethrough, whereas the heat transfer fluid 136 can be retained above the separator. In one embodiment the separator 144 can comprise a grate. However, various other embodiments of the separator can be employed, such as a membrane, an agitator screw, a centrifuge, or other embodiments of liquid separators. Moreover, in some embodiments multiple vessels can be incorporated into the manufacturing system 100.

Figure 6:
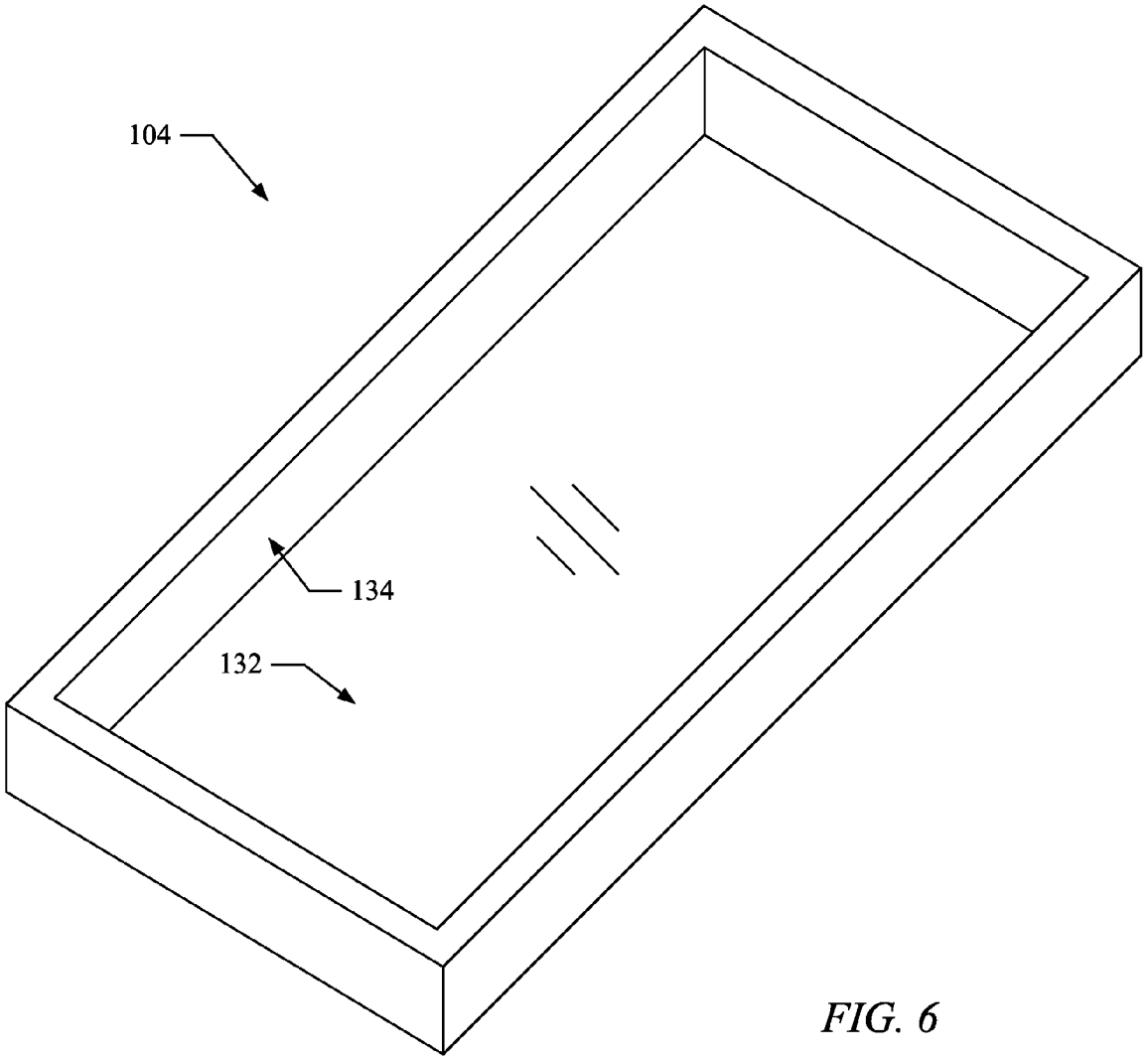
FIG. 6 illustrates a perspective view of the component of FIG. 2 with the cavity machined and the support material removed according to an example embodiment of the present disclosure.

The components 104 can be removed from the vessel 110 after the support material 108 melts therefrom. FIG. 6 illustrates the component 104 after the support material 108 is melted from the walls 134 (or from the cavity 132 in some embodiments). The components 104 can be subjected to one or more additional machining operations. In this regard, the components 104 can optionally have the support material 108 dispensed thereon one or more additional times in order to support the components 104 during the additional manufacturing operations. Accordingly, the components 104 can be directed along a path 148 back to the dispensing apparatus 106.

Figure 7:
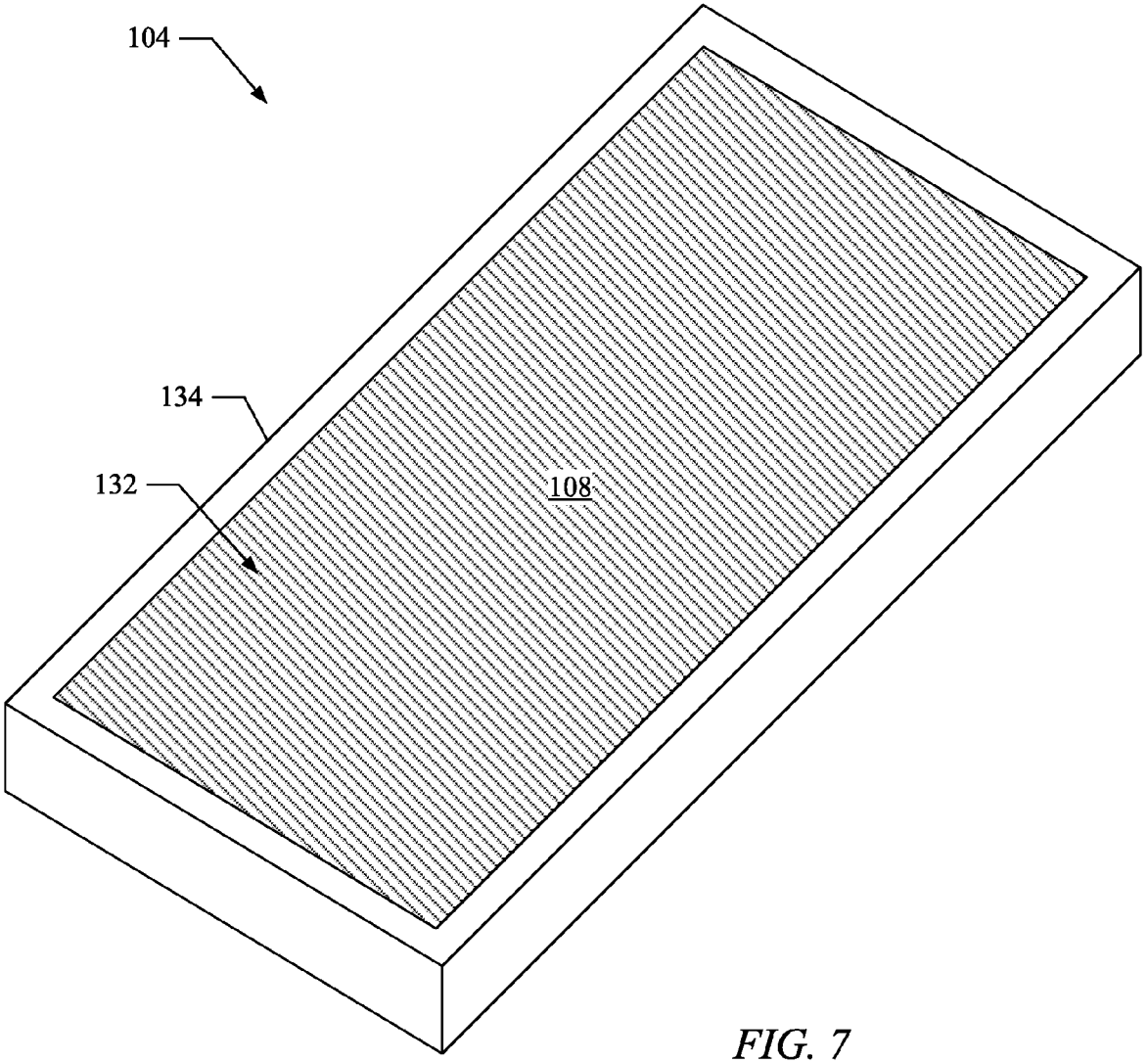
FIG. 7 illustrates a perspective view of the component of FIG. 2 with the cavity machined and filled by the support material according to an example embodiment of the present disclosure.

Thus, the support material 108 can be applied to the components 104 by the dispensing apparatus 106 an additional time in the manner described above. For example, FIG. 7 illustrates support material 108 filling the cavity 132 formed by the machining operations performed by the first machining apparatus 102A. By filling the cavity 132, the walls 134 of the component 104 can be supported by the support material 108. Thus, for example, a second machining apparatus 102B can perform one or more additional manufacturing operations on the component 104. By way of further example, the second machining apparatus 102B can perform manufacturing operations on a side of the component 104 opposite of the side on which the first machining apparatus 102A performed operations on the component 104.

Note, however, that the support material 108 can perform other functions other than supporting the component 104. For example, as noted above, the support material 108 can define a thermal mass that acts as a heat sink, allowing for more heat to be imparted to the component 104 without damaging the component 104 during machining operations performed thereon. Additionally, in some embodiments the dispensing apparatus 106 can dispense the support material 108 such that one or more mounting structures are formed.

Figure 8:
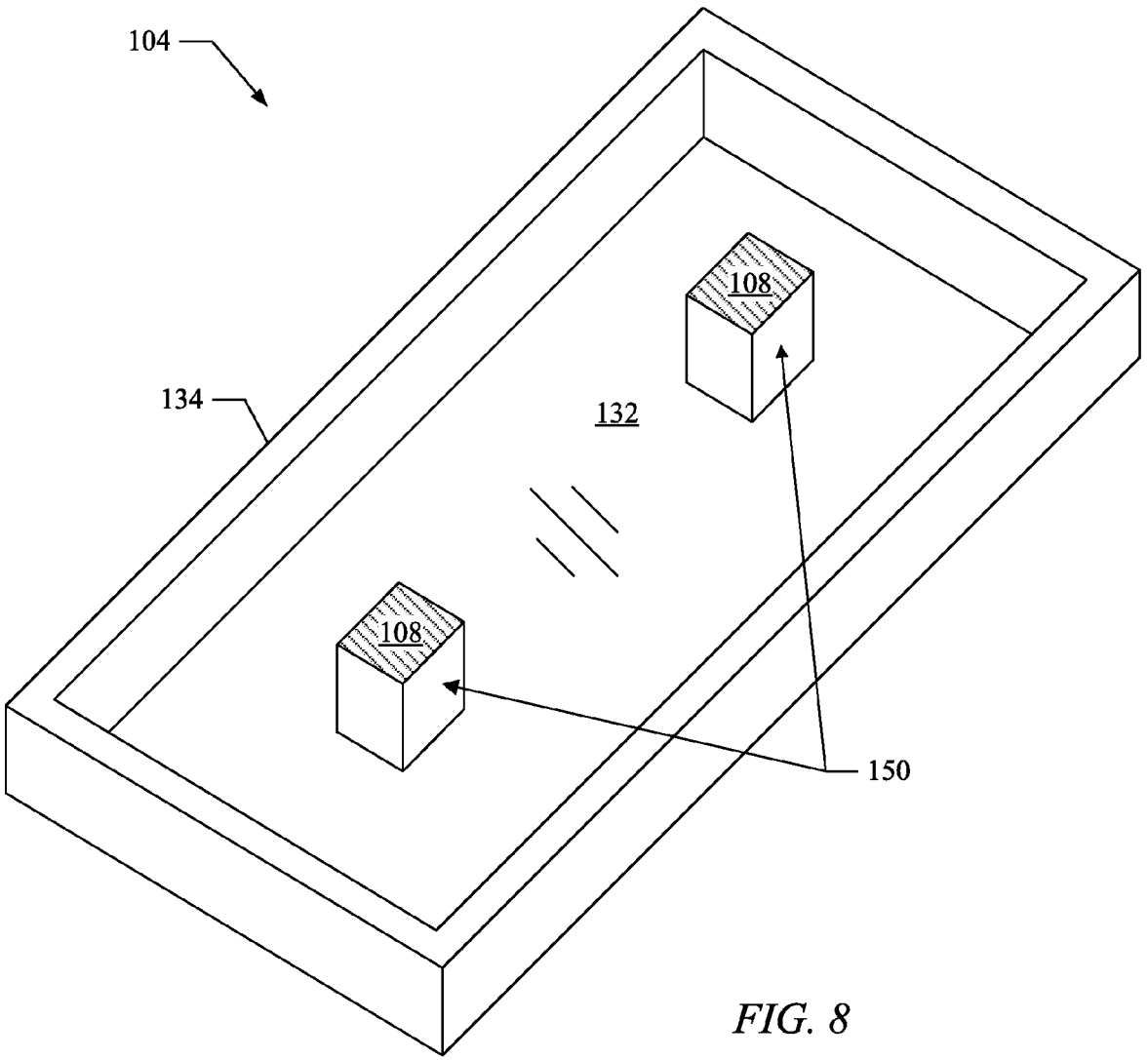
FIG. 8 illustrates a perspective view of the component of FIG. 2 with a plurality of independent mounting structures formed from the support material positioned therein according to an example embodiment of the present disclosure.

For example, FIG. 8 illustrates two mounting structures 150 formed from the support material 108 and positioned in the cavity 132. As illustrated, the mounting structures 150 can be independent such that they are not in direct contact with one another in some embodiments. The mounting structures 150 can be employed to grasp or mount the component 104 during additional machining apparatuses performed by the second machining apparatus 102B and/or during transportation of the component 104 to other manufacturing, assembly, or packaging stations. For example, the support material 108 can define mounting structures or reference points that allow the component 104 to be grasped without touching the component 104 itself in any way, thus avoiding issues with respect to damaging the component 104.

After the optional completion of additional manufacturing operations as can be performed by a second machining apparatus 102B, the component 104 can be returned to the dispensing apparatus 106 such that the support material 108 can be removed therefrom by the heat transfer fluid 136 in the manner described above, and as illustrated in FIG. 1. Finally, the component 104 can be transported along a path 152 for packaging, assembly, or additional operations. Accordingly, as described above, the dispensing apparatus 106 can be employed in a closed-loop manner, whereby the support material 108 is melted and reused after being used as a temporary structure attached to the component 104.

Figure 9:
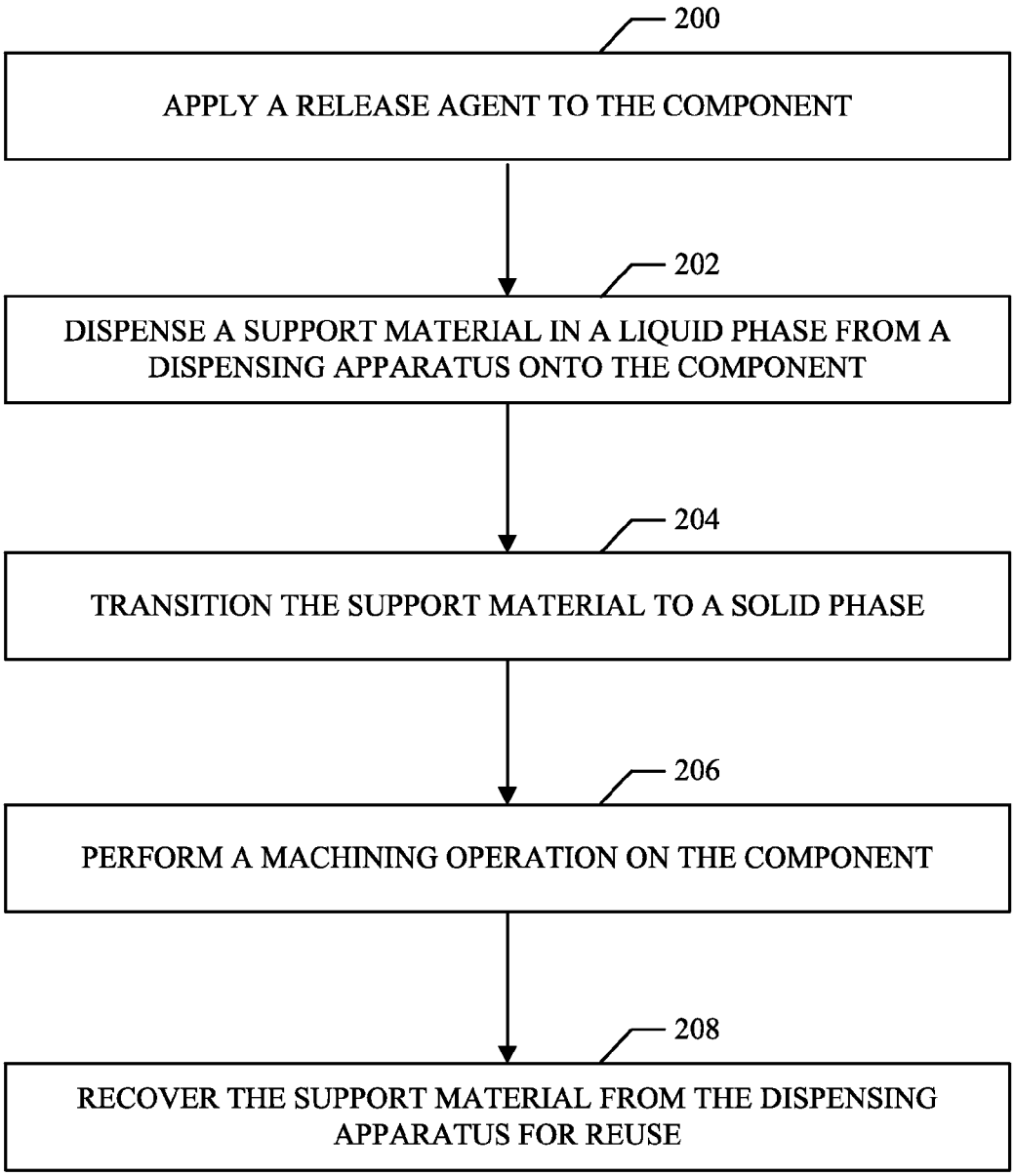
FIG. 9 schematically illustrates a manufacturing method according to an example embodiment of the present disclosure.

A related method for manufacturing is also provided. As illustrated in FIG. 9, the method can include dispensing a support material in a liquid phase from a dispensing apparatus into contact with a component at operation 202. Further, the method can include transitioning the support material to a solid phase at operation 204. Additionally, the method can include performing a machining operation on the component at operation 206. The method can further include recovering the support material in the dispensing apparatus such that the support material can be reused at operation 208. In some embodiments the method can additionally include applying a release agent to the component at operation 200 prior to dispensing the support material thereon at operation 202.

In some embodiments dispensing and transitioning the support material at operations 202 and 204 can comprise forming a plurality of independent mounting structures on the component. Further, transitioning the support material to the solid phase at operation 204 can comprise preloading the component. Additionally, recovering the support material in the dispensing apparatus at operation 208 can comprise submerging the component in a heat transfer fluid. Recovering the support material at operation 208 can further comprise vibrating at least one of the component and the heat transfer fluid and separating the support material from the heat transfer fluid.

Figure 10:
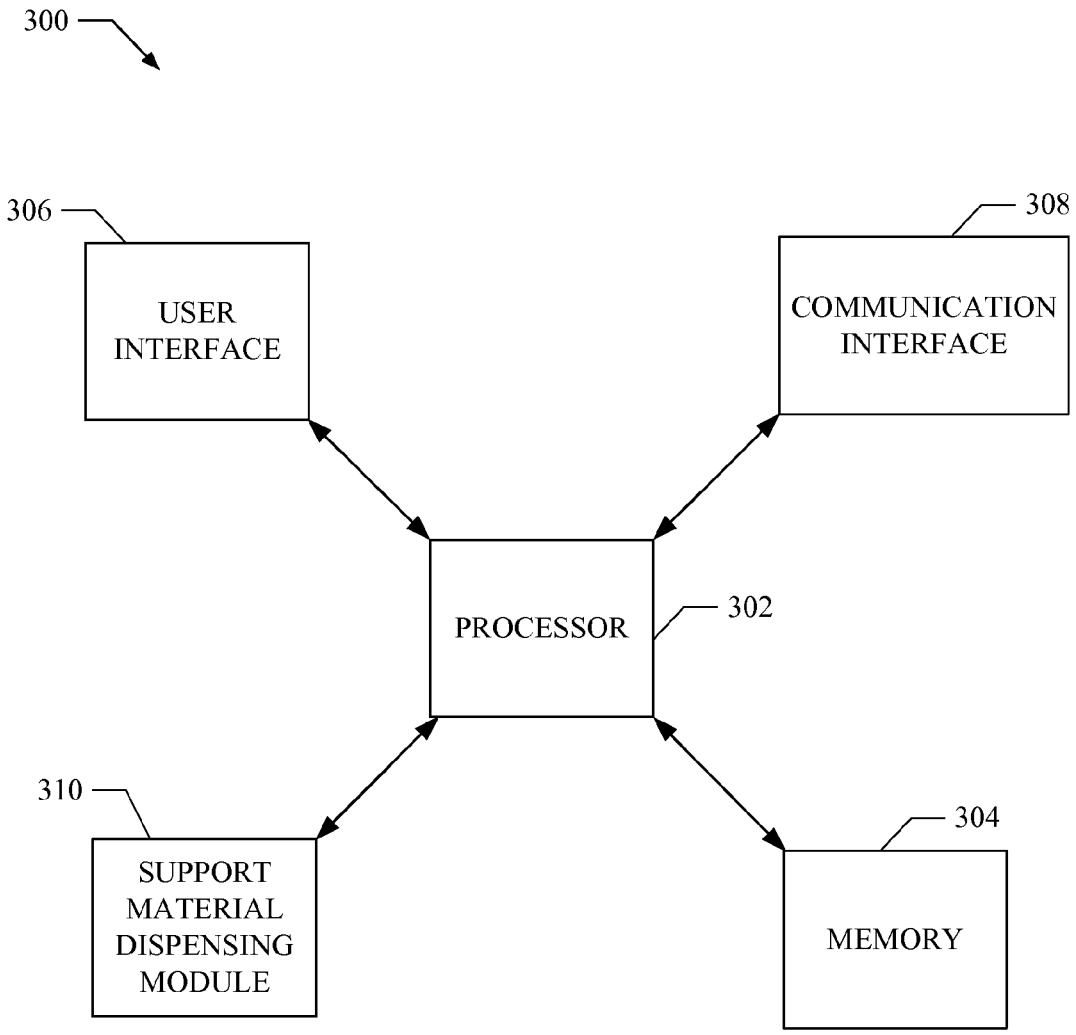
FIG. 10 schematically illustrates a block diagram of an electronic device according to an example embodiment of the present disclosure.

FIG. 10 is a block diagram of an electronic device 300 suitable for use with the described embodiments. In one example embodiment the electronic device 300 can be embodied in or as a controller configured for controlling operations performed in dispensing support material as described herein. In this regard, the electronic device 300 can be configured to control or execute operation of the above-described dispensing apparatus 106 and/or the manufacturing system 100 as a whole.

The electronic device 300 illustrates circuitry of a representative computing device. The electronic device 300 can include a processor 302 that can be a microprocessor or controller for controlling the overall operation of the electronic device 300. In one embodiment the processor 302 can be particularly configured to perform the functions described herein relating to dispensing a support material. The electronic device 300 can also include a memory device 304. The memory device 304 can include non-transitory and tangible memory that can be, for example, volatile and/or non-volatile memory. The memory device 304 can be configured to store information, data, files, applications, instructions or the like. For example, the memory device 304 could be configured to buffer input data for processing by the processor 302. Additionally or alternatively, the memory device 604 can be configured to store instructions for execution by the processor 302.

The electronic device 300 can also include a user interface 306 that allows a user of the electronic device 300 to interact with the electronic device 300. For example, the user interface 306 can take a variety of forms, such as a button, keypad, dial, touch screen, audio input interface, visual/image capture input interface, input in the form of sensor data, etc. Still further, the user interface 306 can be configured to output information to the user through a display, speaker, or other output device. A communication interface 308 can provide for transmitting and receiving data through, for example, a wired or wireless network such as a local area network (LAN), a metropolitan area network (MAN), and/or a wide area network (WAN), for example, the Internet.

The electronic device 300 can also include a support material dispensing module 310. The processor 302 can be embodied as, include or otherwise control the support material dispensing module 310. The support material dispensing module 310 can be configured for controlling or executing support material dispensing operations as discussed herein including, for example, dispensing support material on a component to provide a temporary fixture therefor during manufacturing operations and recovery and reuse of the support material.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A method for reusing a support material by a dispensing apparatus, the method comprising:

dispensing the support material while in a liquid phase onto a component;

causing the support material to transition from the liquid phase to a solid phase such that the support material is bonded to the component during a machining operation;

and subsequent to the machining operation, recovering the support material by submerging the component in a heat transfer fluid retained by the dispensing apparatus, to cause the support material to revert to the liquid phase for reuse.

2. The method of claim 1, wherein the dispensing apparatus includes a first opening and a second opening and the heat transfer fluid is retained between the first and second openings.

3. The method of claim 1, wherein recovering the support material comprises vibrating at least one of the component or the heat transfer fluid.

4. The method of claim 1, wherein recovering the support material comprises separating the support material from the component.

5. The method of claim 1, further comprising:

applying a release agent to the component prior to dispensing the support material onto the component.

6. The method of claim 1, wherein transitioning the support material from the liquid phase to the solid phase comprises preloading the component.

7. The method of claim 1, wherein the dispensing apparatus includes one or more nozzles that are configured to dispense the support material onto the component.

8. The method of claim 1, wherein the heat transfer fluid is comprised of a different material than the support material.

9. A manufacturing system including a machining apparatus, comprising:

a dispensing apparatus configured to:

dispense a support material while in a liquid phase onto a component, cause the support material to transition from the liquid phase into a solid phase such that the support material is bonded to the component prior to the machining apparatus performing a machining operation on the component; and recover the support material, subsequent to the machining operation, by submerging the component in a heated liquid retained by the dispensing apparatus, to cause the support material to revert to the liquid phase such that the support material can be reused.

10. The manufacturing system of claim 9, wherein the dispensing apparatus comprises a vessel having a first opening and a second opening that is configured to retain the heated liquid.

11. The manufacturing system of claim 10, wherein the first opening is configured to dispense the support material onto the component.

12. The manufacturing system of claim 10, wherein the vessel comprises a manifold at the first opening and the manifold includes a plurality of runners that each respectively coupled to a nozzle that is configured to dispense the support material.

13. The manufacturing system of claim 9, wherein the dispensing apparatus comprises a vibration unit configured to vibrate at least one of the component or the heated liquid.

14. The manufacturing system of claim 9, wherein the dispensing apparatus comprises a separator configured to separate the support material from the component.

15. The manufacturing system of claim 9, further comprising a release agent applicator configured to apply a release agent to the component prior to the dispensing apparatus dispensing the support material onto the component.

16. The manufacturing system of claim 9, further comprising a transport apparatus configured to transport the component between the dispensing apparatus and the machining apparatus.

17. The manufacturing system of claim 9, wherein the dispensing apparatus comprises a heating element that generates the heated liquid.

18. The manufacturing system of claim 9, wherein the component is placed in a mold and the support material is applied around a periphery of the component during the machining operation.

19. The manufacturing system of claim 9, wherein transitioning the support material from the liquid phase into the solid phase comprises preloading the component.

20. The manufacturing system of claim 9, wherein the heat transfer fluid is comprised of a different material than the support material.

* * * * *